United States Patent [19]

Yoshida et al.

[11] Patent Number: 4,929,803

[45] Date of Patent: May 29, 1990

[54] PLANAR CONDUCTIVE PIECE WITH ELECTRICAL ANISOTROPHY

[75] Inventors: Masaru Yoshida; Mitsuhiko Yoshikawa; Yoshikazu Yoshimoto; Hiroshi Wada; Tomonari Suzuki; Shigeo Nakajima, all of Nara, Japan

[73] Assignee: Sharp Kabushiki Kaisha, Osaka, Japan

[21] Appl. No.: 370,130

[22] Filed: Jun. 20, 1989

Related U.S. Application Data

[63] Continuation of Ser. No. 164,252, Mar. 4, 1988, abandoned.

[30] Foreign Application Priority Data

Mar. 25, 1987 [JP] Japan ..... 62-72892

[51] Int. Cl.[5] ..... H01B 7/08

[52] U.S. Cl. ..... 174/117 M; 139/425 R

[58] Field of Search ..... 174/117 M; 139/425 R

[56] References Cited

U.S. PATENT DOCUMENTS

| | | | |
|---|---|---|---|
| 3,087,699 | 4/1963 | Foster | 139/425 R |
| 3,582,537 | 6/1971 | Perreault | 174/117 M |
| 3,646,247 | 2/1972 | Sennett et al. | 139/425 R |
| 3,711,627 | 1/1973 | Maringulov | 174/117 M X |
| 3,878,103 | 4/1975 | Miller et al. | 174/117 M X |
| 4,429,179 | 1/1984 | Chynoweth | 174/117 M |
| 4,463,323 | 7/1984 | Piper | 174/117 M X |
| 4,639,545 | 1/1987 | Pithouse et al. | 174/117 M X |
| 4,647,495 | 3/1987 | Kanayama et al. | 139/425 R |
| 4,651,163 | 3/1987 | Sutera et al. | 174/117 M X |

FOREIGN PATENT DOCUMENTS

| | | | |
|---|---|---|---|
| 139849 | 7/1985 | Japan | 139/425 R |
| 1176344 | 1/1970 | United Kingdom | 139/425 R |

*Primary Examiner*—Morris H. Nimmo

*Attorney, Agent, or Firm*—Flehr, Hohbach, Test, Albritton & Herbert

[57] ABSTRACT

A planar conductive piece has groups of conductive and insulative lines arranged in mutually crossing directions and formed unistructurally. The individual conductive lines are kept in mutually non-contacting relationship such that the two groups of lines form a planar conductive piece with electrical anisotropy.

10 Claims, 1 Drawing Sheet

PLANAR CONDUCTIVE PIECE WITH ELECTRICAL ANISOTROPHY

This is a continuation of application Ser. No. 164,252, filed Mar. 4, 1988, now abandoned.

BACKGROUND OF THE INVENTION

This invention relates to a planar conductive piece with electrical anisotropy and more particularly to such a conductive piece having conductive and insulative lines arranged in a lattice formation.

There has not been available any planar conductive piece with electrical anisotropy within its plane and having two or more mutually insulated current paths per 1 millimeter. When a conductive piece is used as a medium for transmitting electrical signals of a high density, therefore, it becomes necessary to provide a large conductor piece with many parallel paths.

SUMMARY OF THE INVENTION

It is therefore an object of the present invention to provide an improved planar conductive piece with electrical anisotropy.

The above and other objects of the present invention are achieved by providing a planar conductive piece with conductive and insulative lines arranged in mutually transversing directions.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figure 1:
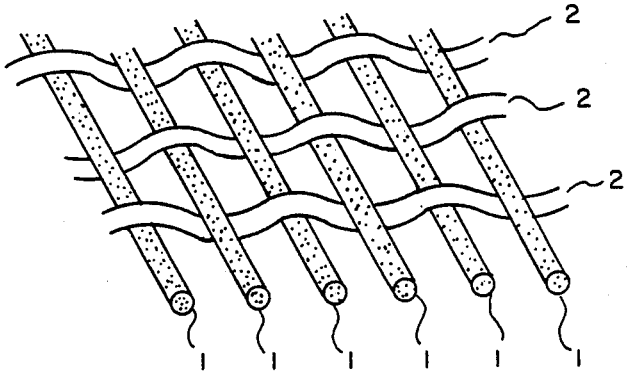
FIG. 1 is schematic view of a portion of a planer conductive piece with electrical anisotropy embodying the present invention.

In what follows, the present invention will be described by way of exemplary embodiments thereof. With reference to FIG. 1 which shows the structure of a planar conductive piece with electrical anisotropy according to one embodiment of the present invention, numerals 1 indicate electroconductive lines of diameter in the range between 10μm and 1mm. They may be metallic such as Co, W, Ag, Al, Cu, Ni, Fe or stainless steel, of a conductive high molecular material or carbon fibers. Numerals 2 indicate insulative lines of diameter in the same range. They may be nylon, Teflon, polyamide of a high molecular insulative material such as Bakelite. The conductive lines 1 are arranged parallel to one another in a direction so as to cross the insulative lines 2 which are also arranged to be mutually parallel among themselves. Each conductive line 1, after crossing one of the insulative lines 2 by passing it over or under, crosses the next one of the insulative lines 2 by passing it under or over, respectively.

Similarly, each insulative line 2, after crossing one of the conductive lines 1 by passing it over or under, crosses the next one by passing it under or over, respectively, thereby forming a unitized, cloth-like, planar, reticulated, lattice-like structure. Since each conductive line 1 is electrically insulated from the adjacent ones in this network, what is obtained is a planar conductive piece with electrical anisotropy. In other words, this cloth-like piece allows currents to flow in one direction in its plane but not in other directions. Since each of the conductive lines 1 is electrically insulated, their diameters can be reduced such that four or more mutually independent current paths per millimeter can be formed (or more than 10 per inch). A network thus formed according to the present invention may be reinforced by a resin material such as epoxy by burying it within such material.

Figure 2:
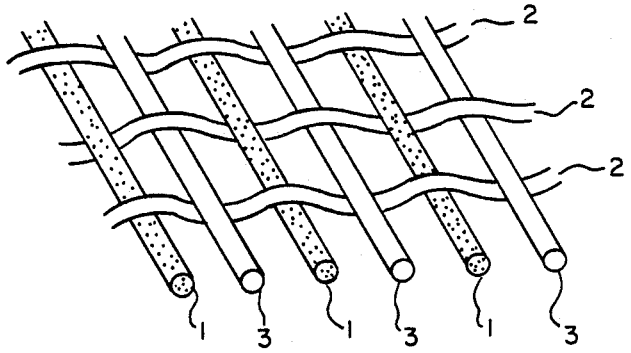
FIG. 2 is a perspective schematic view of a portion of another planar conductive piece with electrical anisotropy embodying the present invention.

Another embodiment of the present invention is shown in FIG. 2 wherein components which are substantially identical or at least similar to those in FIG. 1 are indicated by the same numerals, and wherein numerals 3 indicate insulative lines of the same structure as those indicated by numerals 2. A conductive piece thus structured is characterized as being more reliable in insulating the individual conductive lines 1. Thus, conductive pieces according to this embodiment are preferable if the linear density of the conductive lines 1 (or the number of conductive lines 1 per millimeter) increases. In this example, too, each line in one direction goes alternately over and below the lines which it crosses such that a unistructural, planar, cloth-like reticulated, lattice-like structure with electrical anisotropy is obtained.

The foregoing description of preferred embodiments of the invention has been presented for purposes of illustration and description. It is not intended to be exhaustive or to limit the invention to the precise form disclosed, and many modifications and variations are possible in light of the above teaching. For example, the mutually crossing sets of lines need not be arranged in a knit, mutually interweaving formation if they are buried inside a reinforcing material, as mentioned above, which is electrically insulative such as a resin material. Any modifications and variations that may be apparent to a person skilled in the art are intended to be included within the scope of this invention.

What is claimed is:

1. An electrically anisotropic planar conductive piece capable of simultaneously transmitting mutually independent electrical signals through a plurality of mutually parallel paths in a specified direction, said piece comprising a first group of conductive lines arranged substantially in said specified direction, a second group of insulative lines arranged substantially in said specified direction, and a third group of insulative lines crossing said first and second groups of lines, said lines all having a diameter no less than 10 micrometers and less than 0.05 millimeter, said first and second groups of lines being arranged together at linear density of more than 10 lines but less than 200 lines per inch, said conductive lines being kept in mutually non-contacting and electrically insulated relationship so as to form mutually insulated current paths.

2. The planar conductive piece of claim 1 wherein said third group of insulative lines are arranged at linear density of more than 10 lines but less than 200 lines per inch.

3. The planar conductive piece of claim 1 wherein said conductive lines of said first group said insulative lines of said second group are arranged alternately so as to ensure that said conductive lines of said first group are mutually insulated electrically.

4. The planar conductive piece of claim 2 wherein said conductive lines of said first group said insualtive lines of said second group are arranged alternately so as to ensure that said conductive lines of said first group are mutually insulated electrically.

5. The planar conductive piece of claim 1 wherein said third group of lines are substantially perpendicular to said specified direction.

6. The planar conductive piece of claim 2 wherein said third group of lines are substantially perpendicular to said specified direction.

7. The planar conductive piece of claim 3 wherein said third group of lines are substantially perpendicular to said specified direction.

8. The planar conductive piece of claim 4 wherein said third group of lines and said first and second groups of lines interweave mutually.

9. The planar conductive piece of claim 3 wherein said third group of lines and said first and second groups of lines interweave mutually.

10. The planar conductive piece of claim 4 wherein said third group of lines and said first and second groups of lines interweave mutually.

* * * * *